US007959368B2

(12) United States Patent
Sheu

(10) Patent No.: US 7,959,368 B2
(45) Date of Patent: Jun. 14, 2011

(54) INK CARTRIDGE STRUCTURE FOR PENS

(76) Inventor: Rong-Lin Sheu, Yilan Hsien (TW)

( * ) Notice: Subject to any disclaimer, the term of this patent is extended or adjusted under 35 U.S.C. 154(b) by 630 days.

(21) Appl. No.: 12/021,312

(22) Filed: Jan. 29, 2008

(65) Prior Publication Data

US 2009/0190992 A1 Jul. 30, 2009

(51) Int. Cl.
*B43K 24/02* (2006.01)

(52) U.S. Cl. ..... 401/103

(58) Field of Classification Search ..... 401/103, 401/131, 210
See application file for complete search history.

(56) References Cited

U.S. PATENT DOCUMENTS 2,905,146 A * 9/1959 Johmann ..... 401/103
2,914,027 A * 11/1959 Sears ..... 401/210
2,989,032 A * 6/1961 Bross ..... 401/103
3,039,437 A * 6/1962 Walker ..... 401/210
3,232,278 A * 2/1966 Johmann ..... 401/103
6,196,745 B1 * 3/2001 Smith ..... 401/210
6,257,787 B1 * 7/2001 Kirk ..... 401/104
6,261,015 B1 * 7/2001 McCauley et al. ..... 401/103
7,137,751 B2 * 11/2006 Candelora et al. ..... 401/103

* cited by examiner

*Primary Examiner* — David J Walczak
(74) *Attorney, Agent, or Firm* — Leong C. Lei

(57) ABSTRACT

An ink cartridge structure includes a resilient device coupled to an ink cartridge for absorbing impact energy acting on the ink cartridge for protection of the ink cartridge. The resilient device includes a connection bar mounted to the ink cartridge and is coupled to a retention bar that is accessible by a user with a resilient element therebetween so that the resilient element provides cushioning to the ink cartridge. The connection bar is partially fit into a hollow portion of the retention bar and forms a vent hole that is in communication with the ink cartridge so that when the retention bar, under the resilient support by the resilient element, is manually moved reciprocally with respect to the connection bar, air is pumped, through the vent hole, into the ink cartridge to force the ink contained in the ink cartridge to ward a writing tip.

2 Claims, 8 Drawing Sheets

INK CARTRIDGE STRUCTURE FOR PENS

BACKGROUND OF THE INVENTION (a) Technical Field of the Invention

The present invention relates to a novel design of an ink cartridge structure, and in particular to an ink cartridge structure that comprises a resilient device for cushioning impact and thus protecting the ink cartridge from being damaged or incurring ink discontinuity, wherein the resilient device in arranged at an end of the ink cartridge and an upper end of the ink cartridge forms an internal thread to engage a threaded section formed on a connection bar for adjustability of the biasing force induced by the resilient device and thereby adjusting the force that the resilient device applies to the ink cartridge and wherein a vent hole is provided in the coupling between the resilient device and the ink cartridge so that when the resilient device is compressed, air is pumped into the ink cartridge through the vent hole to keep the ink contained in ink cartridge being driven toward a writing tip of the ink cartridge and discontinuity of ink supply is obviated.

(b) Description of the Prior Art

A conventional pen comprises a barrel in which an ink cartridge is received and fixed in position by threading engagement. Such a structure suffers easy damage to the writing tip or ball point of the ink cartridge due to the fact that no cushioning is provided to absorb impact energy that is applied to the writing tip or ball point when the writing tip is hit by for example an external force or falling onto the ground. When the ball point is damaged, the ball cannot roll smoothly and discharge of ink through the ball is interrupted. The worst case is that the pen is totally broken and cannot be used for writing. A solution to such a problem is a pen including a resiliently supported ink cartridge or ink tube as shown in FIG. 1 of the attached drawings, wherein a pen is composed of a hollow barrel 1 having an upper end forming a recess 11, an ink cartridge or ink tube 10 having an upper end forming a projection 101, and a spring 12. The spring 12 has an end received and retained in the recess 11 of the upper end of the barrel 1 and an opposite end supported on the projection 101 of the upper end of the ink cartridge 10 so that the ink cartridge 10 is subjected to the spring force of the spring 12 to resiliently extend and retract, whereby when the ink cartridge is subjected to an external impact, the spring 12 effects cushioning against the impact force by allowing the ink cartridge 10 to retract back into the barrel 1. Thereafter, when the impact is removed, the spring force of the spring 12 drives the ink cartridge outward for writing. In this way, the ink cartridge can be protected from damage caused by external impact. However, such a spring-cushioning ink cartridge has the following disadvantages:

(1) The assembly of the barrel 1 and the ink cartridge 10, as well s the spring 12, requires first fitting parts into the barrel 1 and then closing the barrel 1 by threading operation. This is certainly very troublesome.

(2) With the ink contained in the ink cartridge 10 fully consumed, the whole pen has to be disposed of and a new pen has to be purchased, because due to the assembly, there is no substitute ink cartridge 10 that is available individually. This makes the pen an uneconomic device.

(3) The lines drawn with the conventional ink cartridge is of a fixed width and the line may get easily broken when the force applied to the pen in the writing process is too light. Other disadvantage is also known for discontinuous line that a pen that has been stowed in an up-side-down manner for a substantial period of time may draw.

Thus, it is desired to provide an ink cartridge for pens to overcome the above drawbacks.

SUMMARY OF THE INVENTION

The primary purpose of the present invention is to provide novel design of an ink cartridge structure and in particular to an ink cartridge structure that comprises a resilient device directly arranged at an end of the ink cartridge so that when a pen that incorporates the ink cartridge accidentally falls onto the ground, the resilient device effectively absorbs most of the impact energy so as to protect the ink cartridge from being damaged or incurring ink discontinuity. In accordance with the present invention, a connection bar is fit to an upper end of the ink cartridge with a resilient element provided thereon and a retention bar is fit to the resilient element so that the resilient element is directly coupled to the end of the ink cartridge. Thus, the ink cartridge structure can be simply deposited into a pen barrel and can be arbitrarily replaced by a new one. Compression of the resilient element allows for control of the up and down movement of the ink cartridge. The connection bar of the ink cartridge is provided with a threaded section to engage an internal thread formed in the upper end of the ink cartridge with adjustability of the penetration depth of the connection bar screwed into the ink cartridge to control the biasing force induced on the ink cartridge. A vent hole is formed in a fitting portion of the connection bar so that when the retention bar is depressed, an amount of air is pumped into the ink cartridge to drive the ink contained in the ink cartridge toward the writing tip of the ink cartridge thereby ensuring smooth writing without incurring ink discontinuity and allowing adjustment of line width scratched with the ink cartridge.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
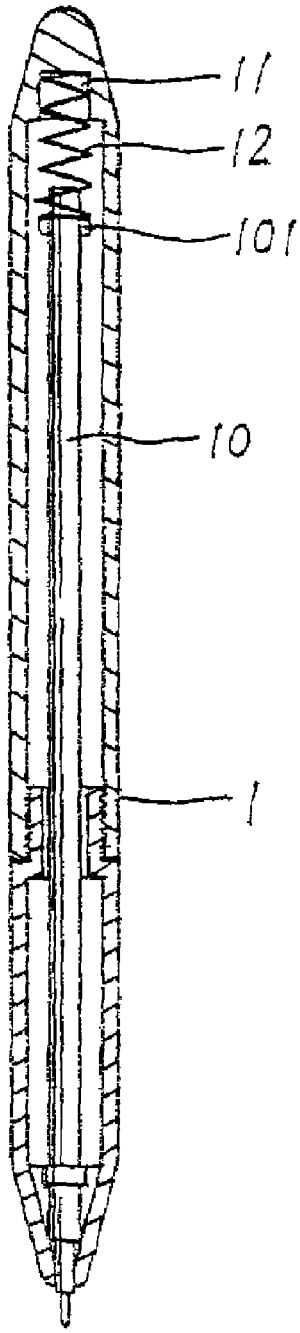
PRIOR ART FIG. 1
FIG. 1 is a cross-sectional view of a conventional pen.
Figure 2A:
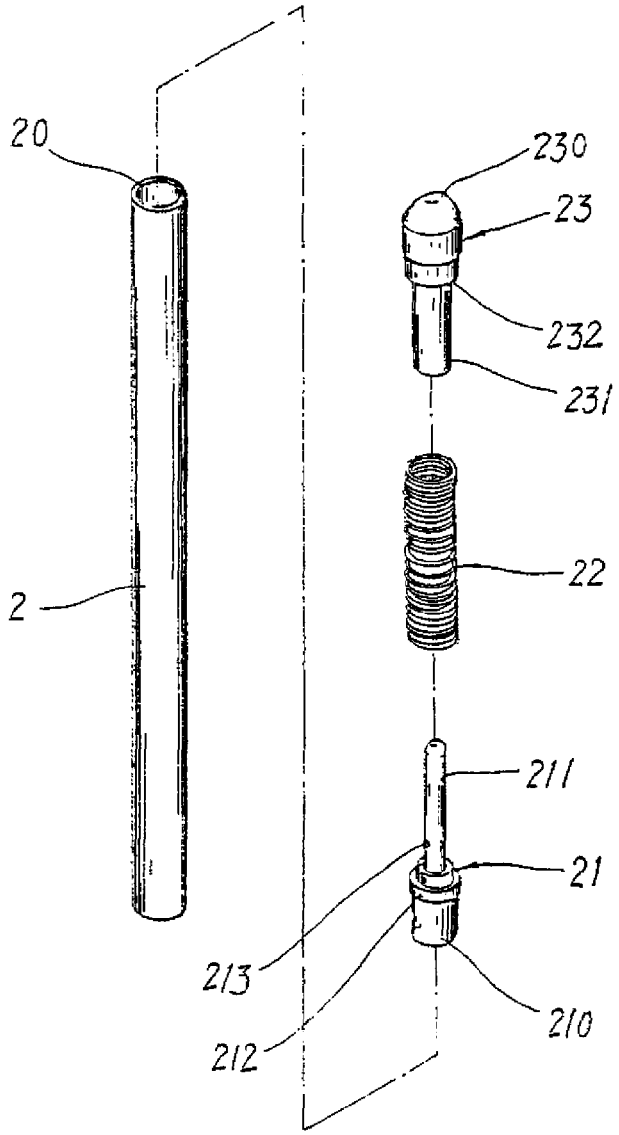
FIG. 2A is a exploded view of an ink cartridge device in accordance with the present invention.
Figure 2B:
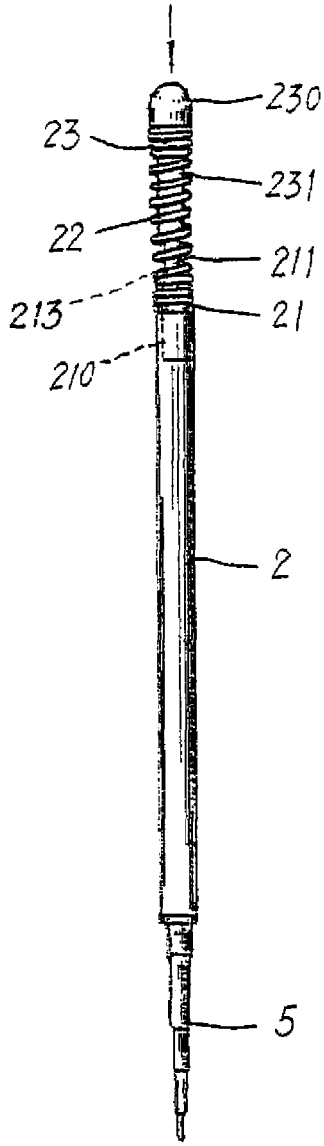
FIG. 2B is a perspective view of the present invention.
Figure 3:
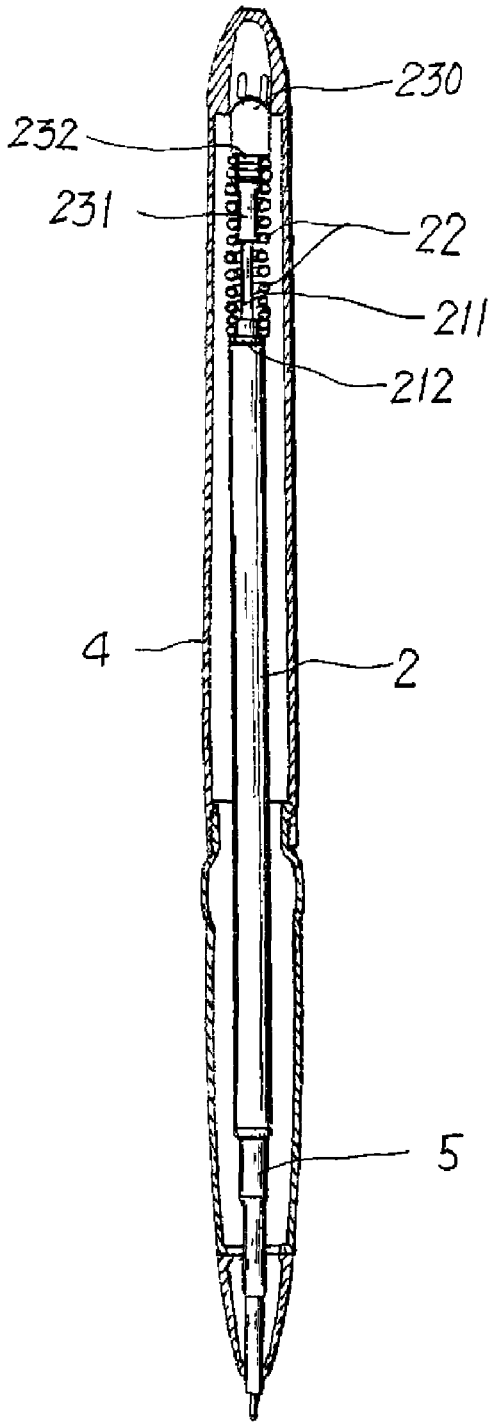
FIG. 3 is a cross-sectional view of a pen in which the ink cartridge device of the present invention is embodied.

The present invention provides a design of an ink cartridge incorporating a resilient device, which ink cartridge, as particularly shown in FIGS. 2A and 2B that illustrate the ink cartridge device in accordance with the present invention, comprises an outer casing 4, an ink cartridge bar 2, a connection bar 21, a resilient element 22, and a retention bar 23. The ink cartridge bar 2 is a hollow member forming in an upper end thereof a fitting hole 20 and is fit to an ink cartridge 5 or is integrally formed with the ink cartridge 5, as shown in FIG. 3. The connection bar 21 has a lower end forming an insertion portion 210 and an upper end forming a fitting portion 211 and an intermediate section forming a sideway-projecting circumferential flange 212. The connection bar 21 also forms a vent hole 213 in the fitting portion, preferably at a lower half thereof. The resilient element 22, which in the embodiment illustrated comprises a helical spring, is fit onto the fitting portion 211 and is retained on the circumferential flange 212. The retention bar 23 has a lower end forming a fitting portion 231 that is fit into the resilient element 22 and is also partially and movably fit over the fitting portion 211 of the connection bar 21 and an upper end forming a coupling ring 232 for coupling to the resilient element 22 at the time the resilient element 22 is fit thereto. Further, the upper end of the retention bar 23 forms an expanded end portion 230 that has an outside diameter that is greater than the diameter of the resilient element 22. The top of the retention bar 23 bears against the inner top end of the outer casing 4 so that when a user holds the outer casing 4 to use the ink cartridge 5 to write on a piece of paper, the ink cartridge bar 2 will be forced to go upwardly thereby causing the retention bar 23 to be depressed in relation to the ink cartridge 5.

The assembling of the ink cartridge will be described with reference to FIGS. 2A, 2B and 3. As shown, no matter being fit to or integrally formed with the ink cartridge 5, the ink cartridge bar 2 has the fitting hole 20 formed on the upper free end thereof so that the connection bar 21 can use the insertion portion 210 on the lower portion thereof to fit to the fitting hole 20 of the upper end of the ink cartridge bar 2 for mounting and uses the circumferential flange 212 to abut against the upper end of the ink cartridge bar 2. The resilient element 22 is then fit over the fitting portion 211 of the connection bar 21 and is retained by the circumferential flange 212. The fitting portion 231 of the lower end of the retention bar 23 is of a hollow configuration that has a size slightly greater than the fitting portion 211 so that when the fitting portion 231 is fit into the resilient element 22, the fitting portion 231 is also fit, at least partly, over the fitting portion 211 with the coupling ring 232 set in coupling with the resilient element 22 for mounting and positioning and the expanded end portion 230 engaging and fixed at an upper end of the resilient element 22. Thus, when the expanded end 230 is subjected to forcible depression, the resilient element 22 is compressed, making the fitting portion 231 to move up and down with respect to the fitting portion 211. Consequently, the ink cartridge device in accordance with the present invention can be pre-assembled for separately sale and replacement and there will be no need to discard the whole pen when the ink cartridge device runs out of ink. This makes the ink cartridge of the present invention more economic.

Figure 4:
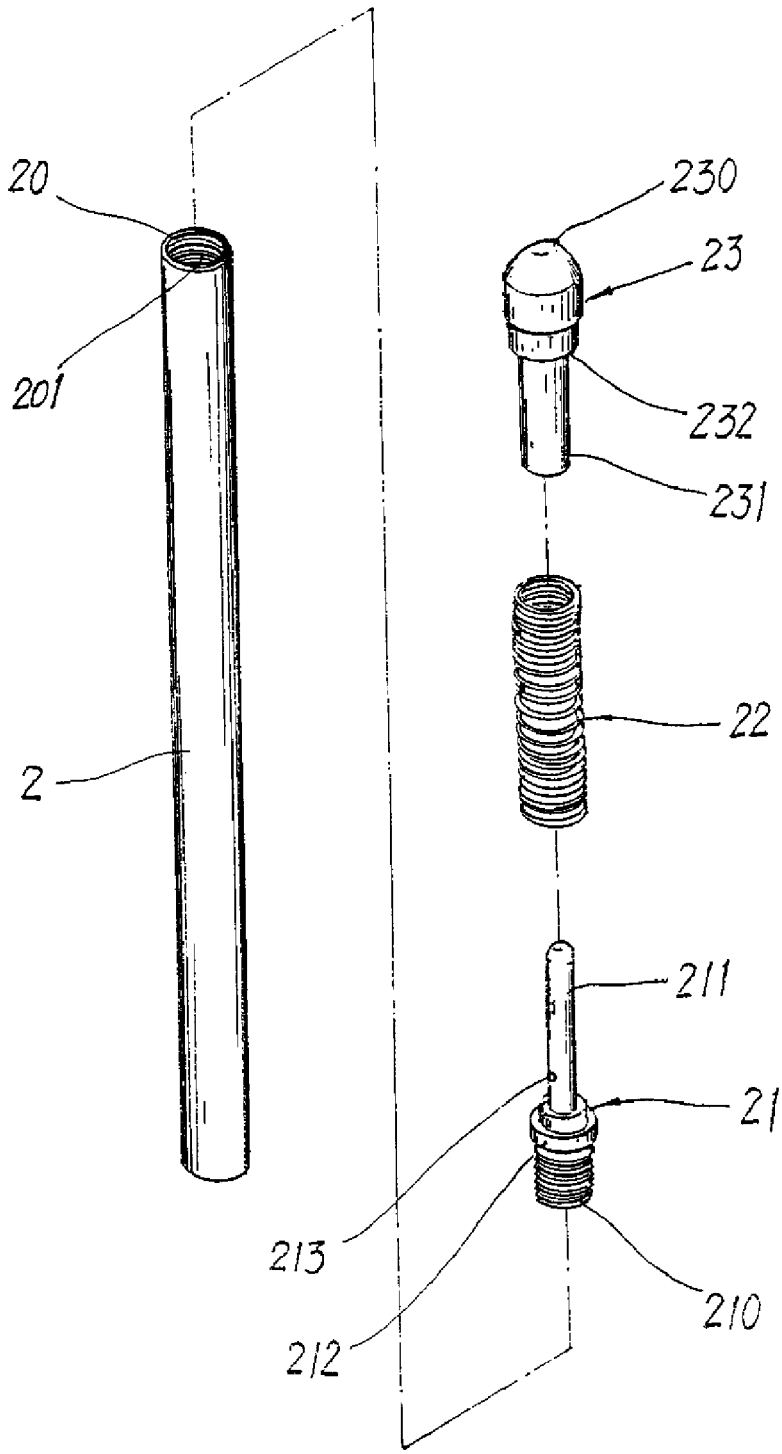
FIG. 4 is an exploded view of an ink cartridge device in accordance with another embodiment of the present invention.
Figure 5:
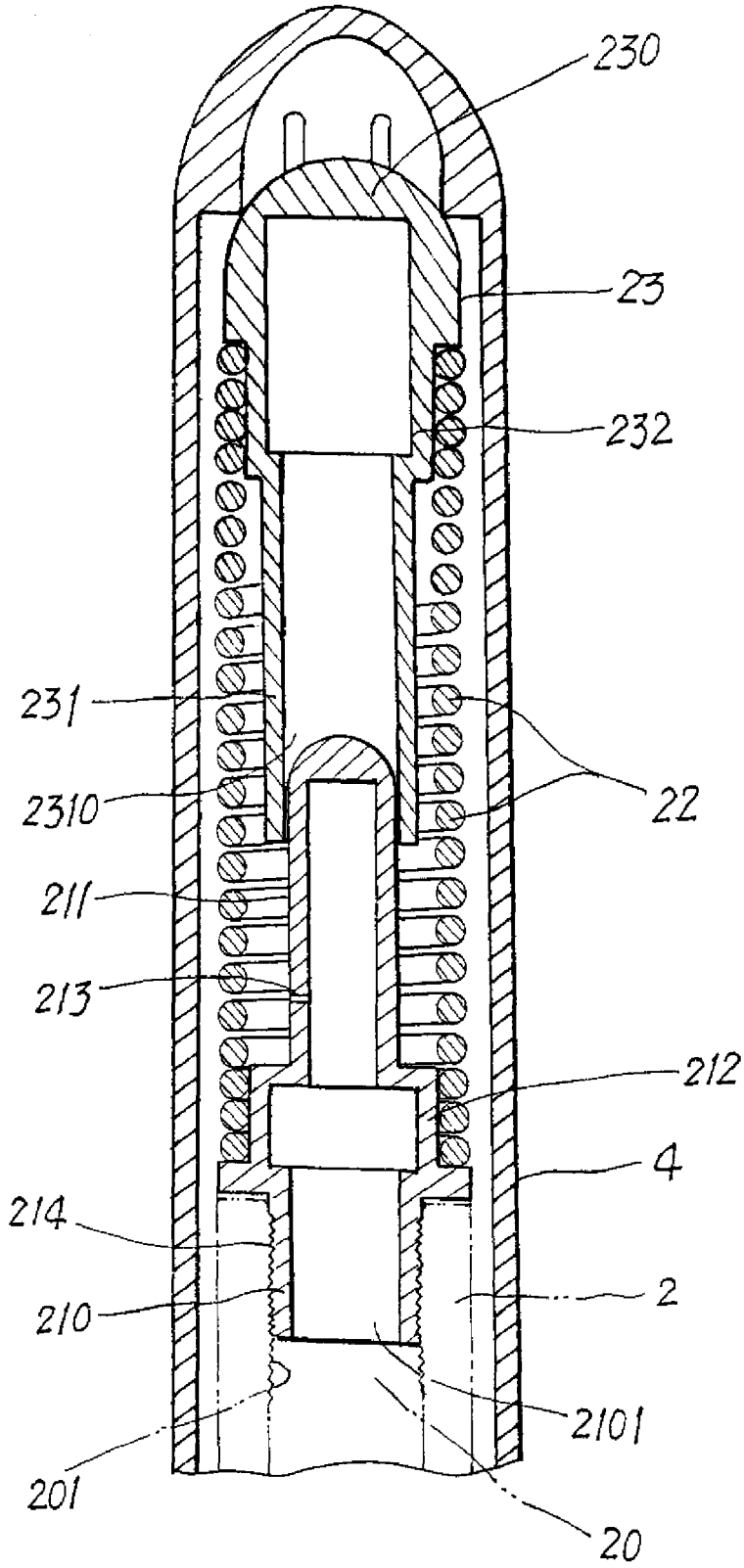
FIG. 5 is a cross-sectional view of a resilient device of the ink cartridge device of the present invention.

As to the coupling between the insertion portion 210 of the connection bar 21 and the ink cartridge bar 2, reference is made to FIGS. 4 and 5, which illustrate another embodiment in accordance with the present invention, wherein the insertion portion 210 of the connection bar 21 forms an external thread 214 and the fitting hole 20 that is formed on the upper end of the ink cartridge bar 2 forms, on an inside surface thereof, an internal thread 201 engageable with the external thread 214 so that the connection bar 21 is threadingly fixed to the ink cartridge bar 2. Further, based on the extent that the connection bar 2 is threaded into the ink cartridge bar 2, the biasing force induced by the resilient element 2 can be adjusted so that the optimum biasing force can be provided to accommodate different writing styles and forces taken by different pen users. And multiple stage adjustment can be realized.

Figure 6:
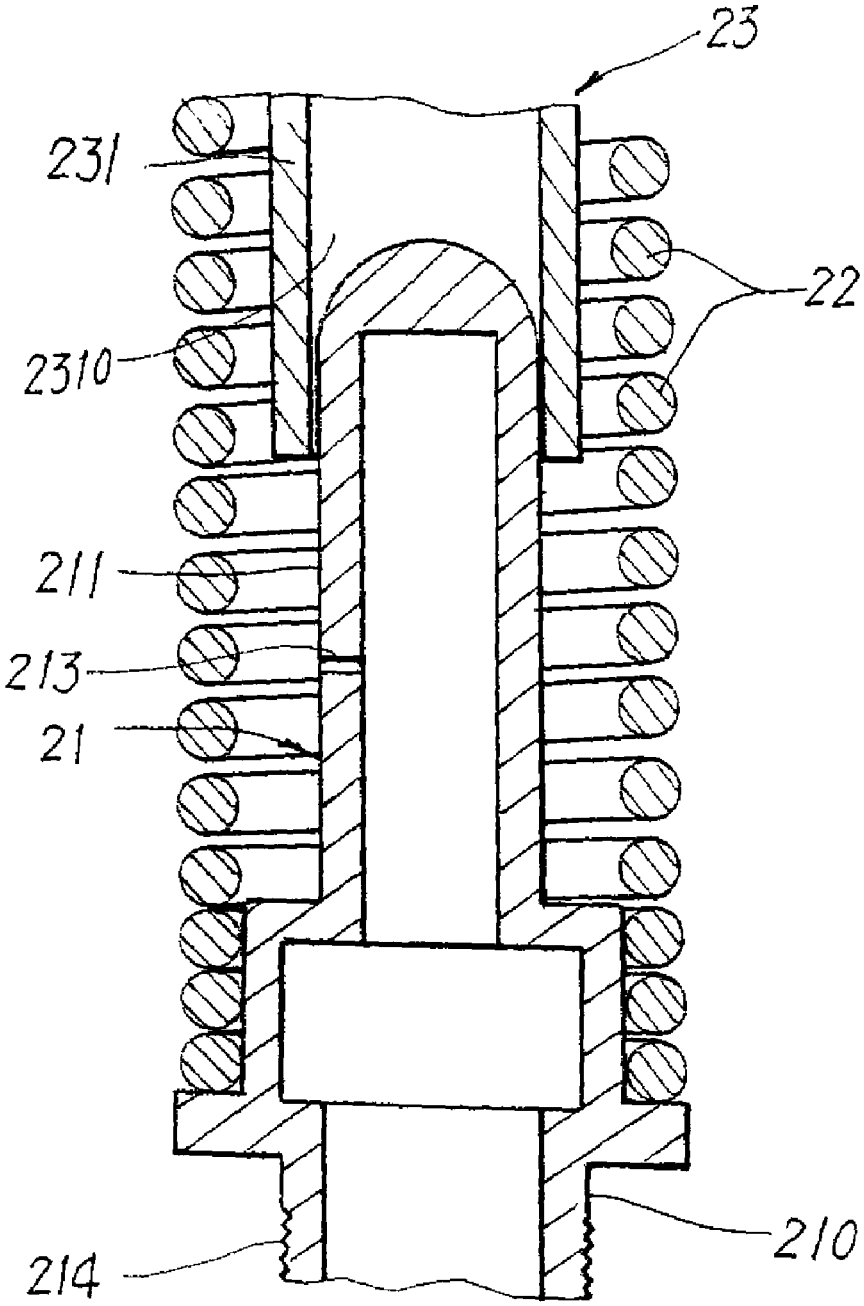
FIG. 6 is a cross-sectional view illustrating a vent hole that is formed in a connection bar of the ink cartridge device of the present invention.
Figure 7:
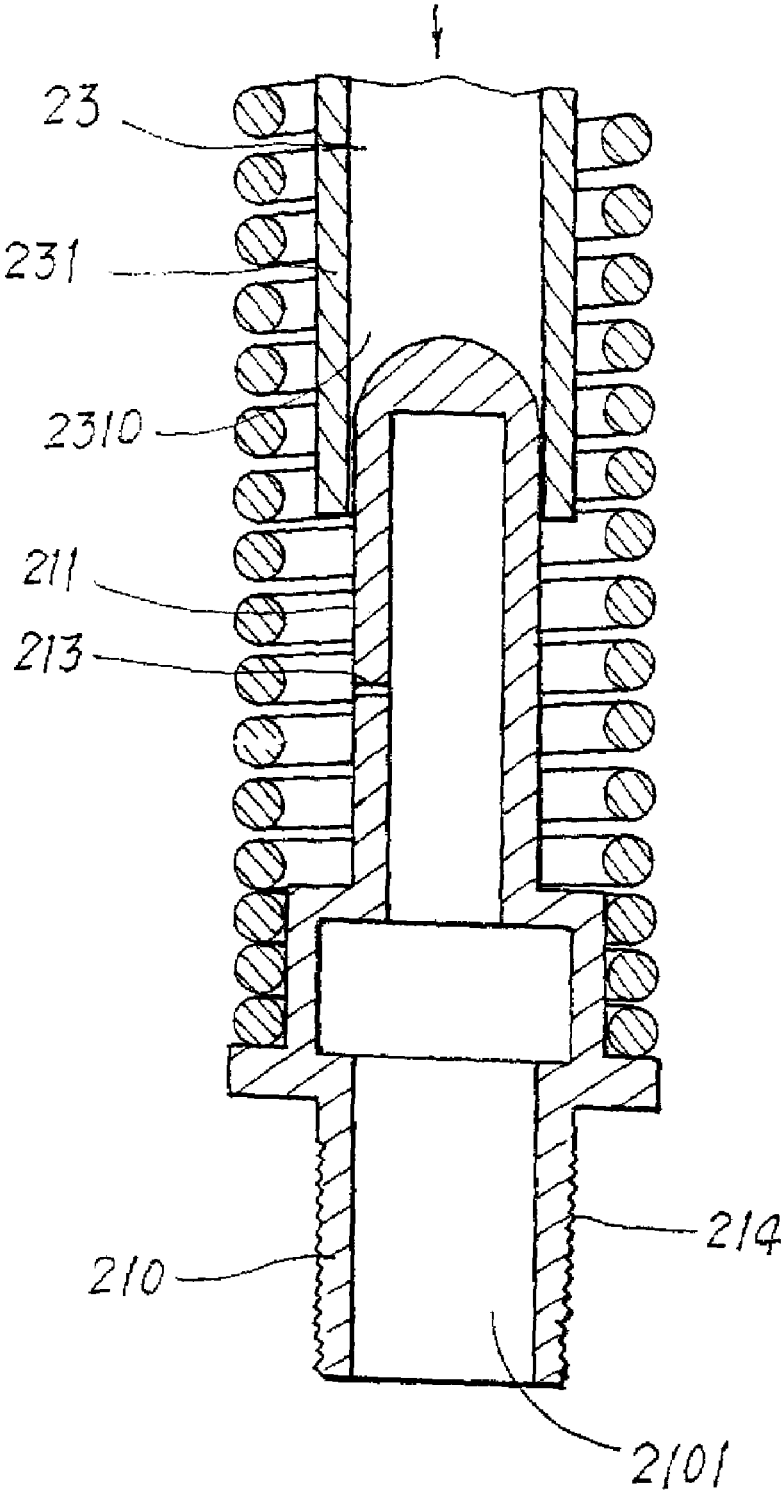
FIG. 7 is a cross-sectional view illustrating coupling between a retention bar and the connection bar of the ink cartridge device of the present invention.
Figure 8:
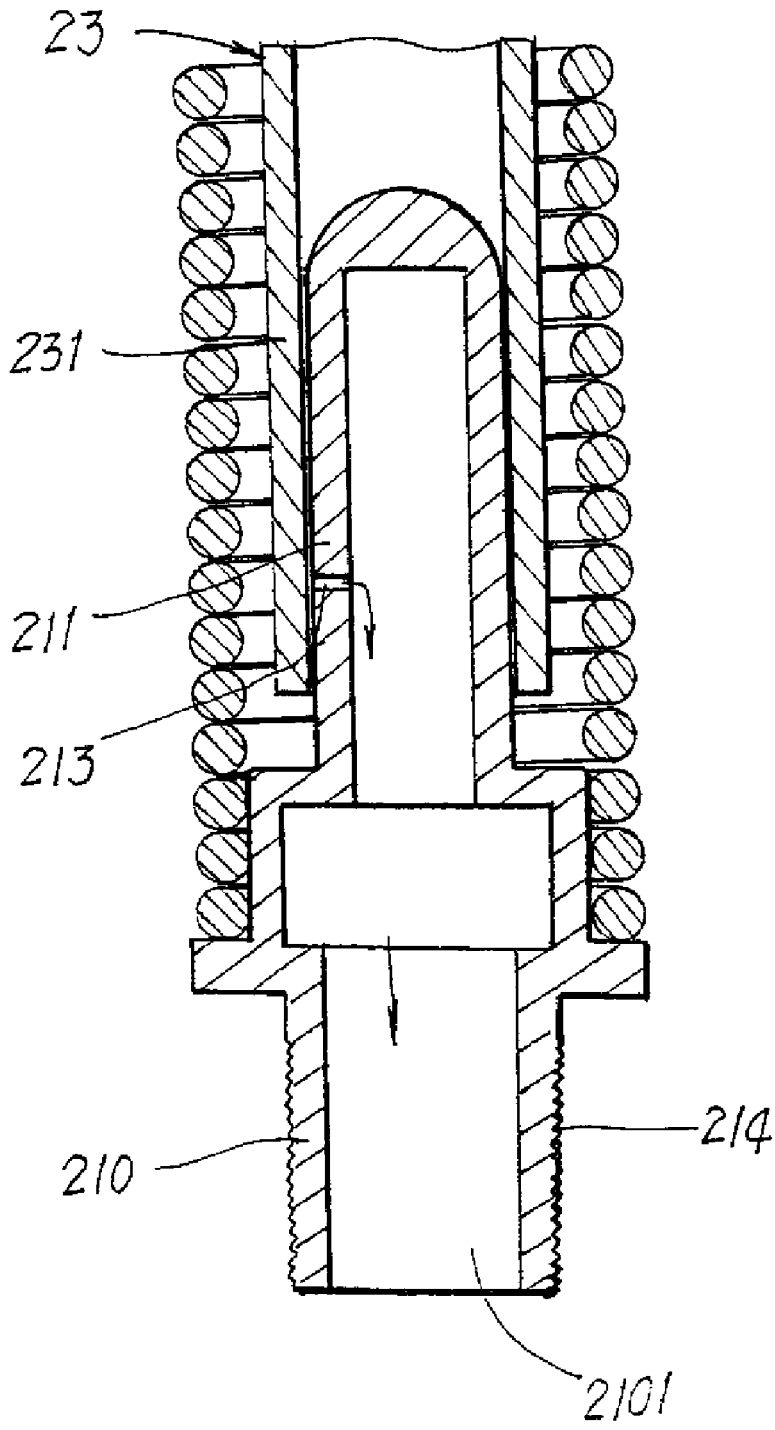
FIG. 8 is a cross-sectional view illustrating the condition when retention bar is depressed and thus moved with respect to the connection bar.

The vent hole 213 that is formed on the connection bar 21 will be described with reference to FIG. 6. The fitting portion 211 that constitutes the upper portion of the connection bar 21 forms in a lower half thereof the vent hole 213, which is in communication with an interior space 2101 (see FIGS. 5 and 7) formed inside the insertion portion 210 and which, when the insertion portion 210 is screwed into the fitting hole 20 of the upper end of the ink cartridge bar 2, is set in communication with the ink cartridge 5. When the retention bar 23 is depressed, the fitting portion 231 is moved up and down with respect to the fitting portion 211 of the connection bar 21 and air is expelled out of the interior space or bore 2310 of the retention bar 23, as shown in FIGS. 6 and 7. However, when the fitting portion 231 is fit over the fitting portion 211 exceeding a predetermined length, which is determined by the location of the vent hole 213, the fitting portion 213 extends beyond the vent hole 213 so that a portion of air that is expelled out of the bore 2310 of the retention bar 23 is forced into the interior space 2101 of the insertion portion 210 of the connection bar 21 through the vent hole 213 and communicates the ink cartridge 5 to induce an expulsion force that drives the ink contained in the ink cartridge 5 toward to writing tip of the ink cartridge thereby making writing more smoothly without any discontinuity of ink scratch.

When in use of the pen, the resilient device provided by the present invention protects the ink cartridge 5 from being damaged or ink discontinuity by impact by an external force due to falling of the pen. More particularly, the tension of the resilient device can be adjusted and set as desired by the penetration depth that the connection bar 21 screwed into the upper end of the ink cartridge bar 2 to ensure smooth writing and to effect regulation of writing line widths in accordance with force that is applied to write so that a single pen may provide writing lines of different sizes, such as 0.38, 0.5 or 0.7 mm, with completely no ink discontinuity. Further, the arrangement of the vent hole 213 also air to be pumped into the ink cartridge 5 by depressing the end portion 230 of the retention bar 23 to induce reciprocation of the retention bar 23 with respect to the connection bar 21, whereby the ink contained inside the ink cartridge 5 can be forced toward the writing tip so that even the ink cartridge 5 is used to write in an up-side-down manner, ink discontinuity cannot occur. This is apparently a remarkable improvement over the known writing implements.

To this end, it is apparent the resilient device provided by the present invention, together with the simple construction of threading and vent hole, allows adjustment of depression force by adjusting the location of the connection bar by means of threading coupling so that the rigidness of the depression of ink cartridge can be selectively modified. Further, the vent hole allows for pumping of a given amount of air to the ink cartridge to ensure continuity of supply of ink so that the writing can be smoother and ink discontinuity can be obviated.

Although the present invention has been described with reference to the preferred embodiments thereof, it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a pen having a holder and an ink cartridge device fitted in said holder, the improvement wherein said ink cartridge device comprises:

an ink cartridge bar which is a hollow member having a lower end provided with an ink cartridge and an upper end forming a fitting hole provided with internal threads;

a connection bar having a lower end forming an insertion portion provided with external threads engageable with said internal threads of said fitting hole of said ink cartridge bar, an upper end forming a first fitting portion, and an intermediate section forming a sideway-projecting circumferential flange, said first fitting portion having a vent hole which is in communication with an interior space formed inside said insertion portion and which is set in communication with said ink cartridge when said insertion portion is screwed into said fitting hole of said ink cartridge bar;

a resilient element fitted onto said first fitting portion of said connection bar and retained on said circumferential flange of said connection bar;

a retention bar having a lower end forming a second fitting portion fitted into said resilient element and partially and movably fitted over said first fitting portion, said retention bar having a coupling ring above said second fitting portion for coupling to said resilient element, said retention bar having an upper end forming an expanded end portion that has an outside diameter that is greater than a diameter of said resilient element, said second fitting portion having an interior space;

wherein when said expanded end of said retention bar is subjected to forcible depression, said resilient element is compressed thereby making said second fitting portion of said retention bar to move up and down with respect to said first fitting portion of said connection bar and therefore causing air to be expelled out of said interior space of said retention bar and forced into said interior space of said insertion portion of said connection bar through said vent hole and communicating said ink cartridge to induce an expulsion force that drives ink contained in said ink cartridge to toward a tip of said ink cartridge thus ensuring writing without any discontinuity of ink scratch, and wherein biasing force induced by said resilient element can be regulated by adjusting engagement between said connection bar and said ink cartridge bar so that an optimum biasing force can be provided to accommodate different writing styles and forces taken by different pen users.

2. The ink cartridge device as claimed in claim 1, wherein said resilient element is a helical spring.

* * * * *